US011417248B1

(12) United States Patent
Barnett

(10) Patent No.: US 11,417,248 B1
(45) Date of Patent: Aug. 16, 2022

(54) ABANDONED VEHICLE MESSAGING SIGN

(71) Applicant: Edward Barnett, Cumberland Gap, TN (US)

(72) Inventor: Edward Barnett, Cumberland Gap, TN (US)

( * ) Notice: Subject to any disclaimer, the term of this patent is extended or adjusted under 35 U.S.C. 154(b) by 10 days.

(21) Appl. No.: 17/146,540

(22) Filed: Jan. 12, 2021

(51) Int. Cl.

| | |
|---|---|
| ***F21V 23/00*** | (2015.01) |
| ***F21S 10/06*** | (2006.01) |
| ***F21V 23/06*** | (2006.01) |
| ***F21V 23/04*** | (2006.01) |
| ***G09F 21/04*** | (2006.01) |
| ***G09F 13/18*** | (2006.01) |
| ***F21S 9/02*** | (2006.01) |
| *F21Y 115/10* | (2016.01) |

(52) U.S. Cl.
CPC ..... *G09F 21/04* (2013.01); *F21S 9/02* (2013.01); *F21S 10/06* (2013.01); *F21V 23/004* (2013.01); *F21V 23/0464* (2013.01); *F21V 23/06* (2013.01); *G09F 13/18* (2013.01); *F21Y 2115/10* (2016.08); *G09F 2013/1881* (2013.01); *G09F 2013/1886* (2013.01)

(58) Field of Classification Search
CPC . B60Q 7/00; B60Q 1/503; B60Q 1/52; B60Q 1/2611
See application file for complete search history.

(56) References Cited

U.S. PATENT DOCUMENTS

| | | | | |
|---|---|---|---|---|
| 3,274,548 | A * | 9/1966 | Brimsek | G09F 21/042 40/575 |
| 4,062,139 | A | 12/1977 | Klosel | |
| 4,208,820 | A | 6/1980 | Cole | |
| 4,888,893 | A | 12/1989 | Jones | |
| 5,156,274 | A | 10/1992 | Williams | |
| D336,932 | S | 6/1993 | Davis | |
| 6,651,367 | B1 | 11/2003 | Barragan | |
| 6,688,027 | B2 * | 2/2004 | Fink | G09F 7/00 40/591 |
| 6,707,389 | B2 * | 3/2004 | Pederson | B60Q 1/2611 340/471 |

FOREIGN PATENT DOCUMENTS

| | | |
|---|---|---|
| WO | 2002090144 | 5/2001 |

* cited by examiner

*Primary Examiner* — William J Carter
(74) *Attorney, Agent, or Firm* — Kyle A. Fletcher, Esq.

(57) ABSTRACT

The abandoned vehicle messaging sign comprises a housing, a control circuit, a display surface, and a vehicle. The control circuit and the display surface mount in the housing. The housing mounts on the vehicle. The abandoned vehicle messaging sign displays an image of indicia indicating a sentiment that the vehicle has been abandoned. By abandoned is meant that the vehicle has been left temporarily unattended. The sentiment indicated by the abandoned vehicle messaging sign is customizable to the specific circumstances regarding the abandonment of the vehicle.

17 Claims, 4 Drawing Sheets

ABANDONED VEHICLE MESSAGING SIGN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of signs including signs that are readily detachable from the supporting structure. (G09F7/02)

SUMMARY OF INVENTION

The abandoned vehicle messaging sign comprises a housing, a control circuit, a display surface, and a vehicle. The control circuit and the display surface mount in the housing. The housing mounts on the vehicle. The abandoned vehicle messaging sign displays an image of indicia indicating a sentiment that the vehicle has been abandoned. By abandoned is meant that the vehicle has been left temporarily unattended. The sentiment indicated by the abandoned vehicle messaging sign is customizable to the specific circumstances regarding the abandonment of the vehicle.

These together with additional objects, features and advantages of the abandoned vehicle messaging sign will be readily apparent to those of ordinary skill in the art upon reading the following detailed description of the presently preferred, but nonetheless illustrative, embodiments when taken in conjunction with the accompanying drawings.

In this respect, before explaining the current embodiments of the abandoned vehicle messaging sign in detail, it is to be understood that the abandoned vehicle messaging sign is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the abandoned vehicle messaging sign.

It is therefore important that the claims be regarded as including such equivalent construction insofar as they do not depart from the spirit and scope of the abandoned vehicle messaging sign. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
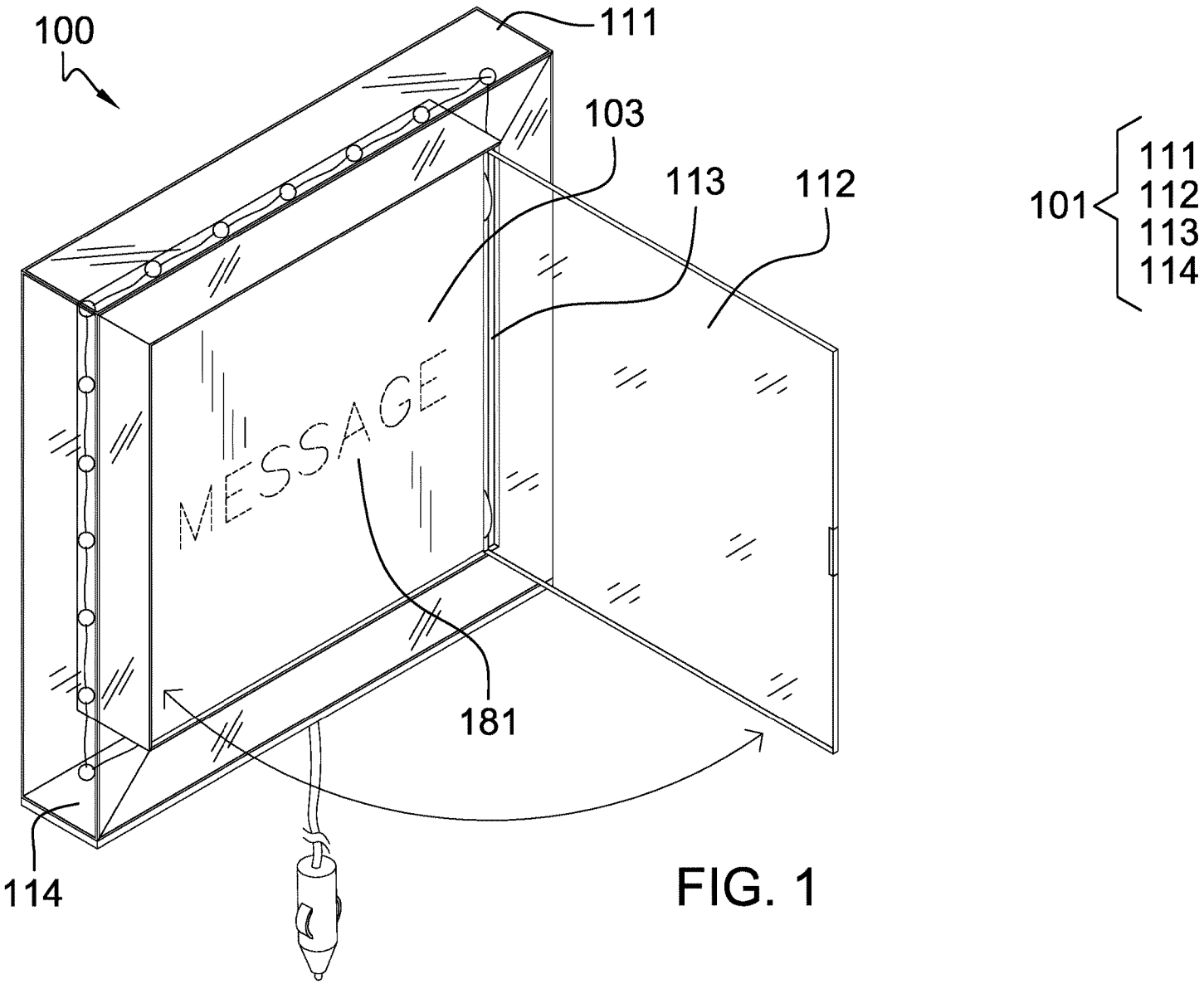
FIG. 1 is a perspective view of an embodiment of the disclosure.
Figure 3:
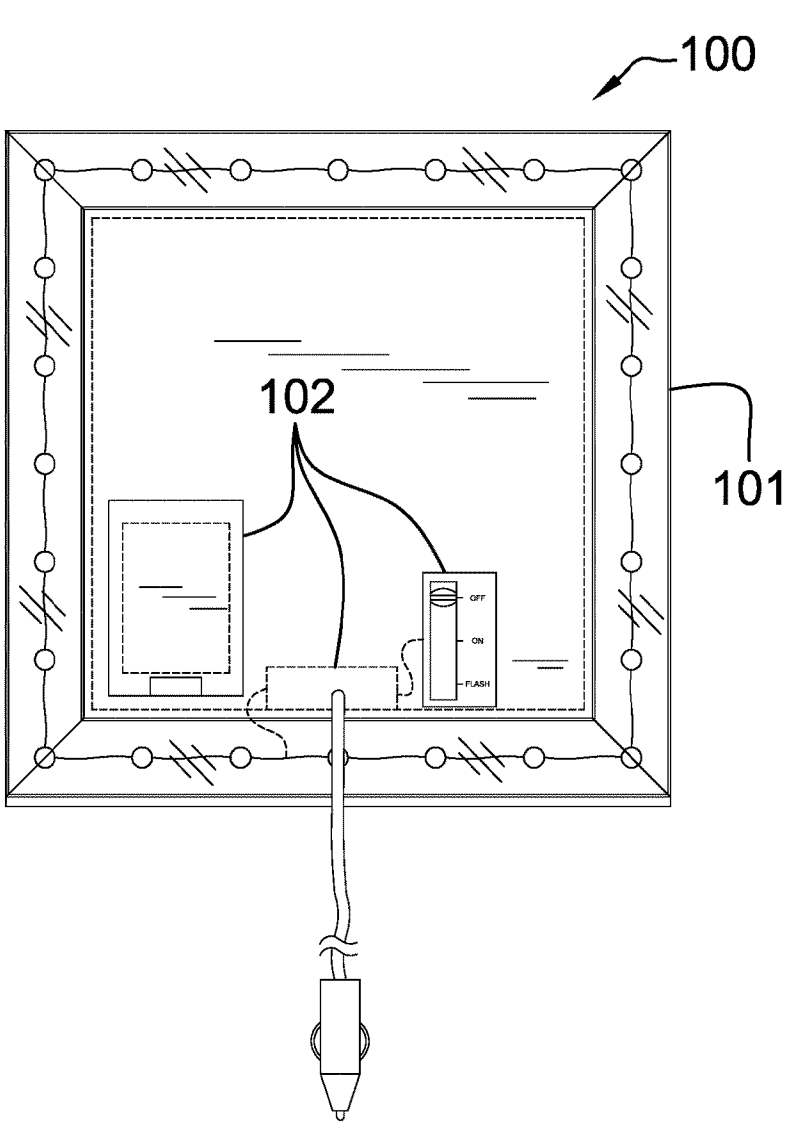
FIG. 3 is a rear view of an embodiment of the disclosure.
Figure 2:
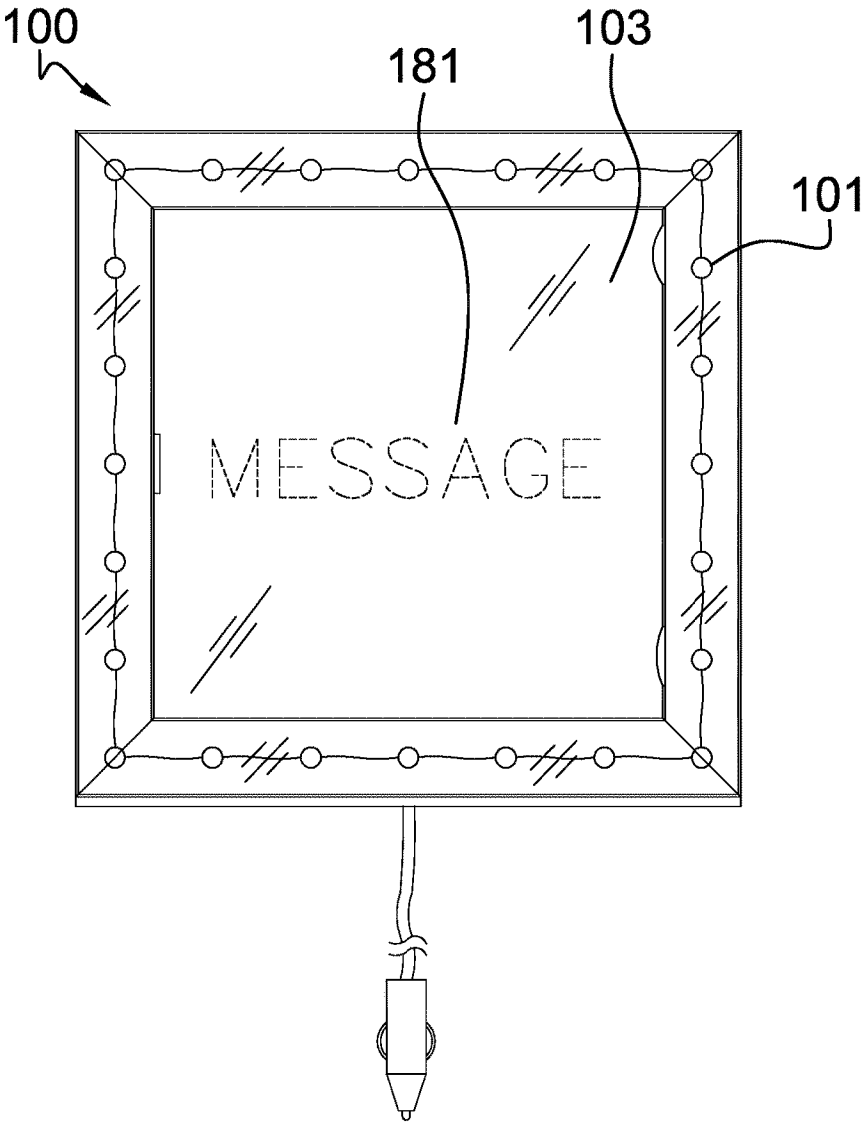
FIG. 2 is a front view of an embodiment of the disclosure.
Figure 5:
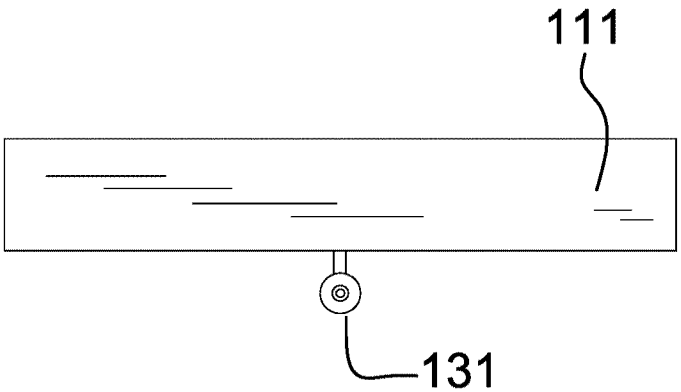
FIG. 5 is a top view of an embodiment of the disclosure.
Figure 4:
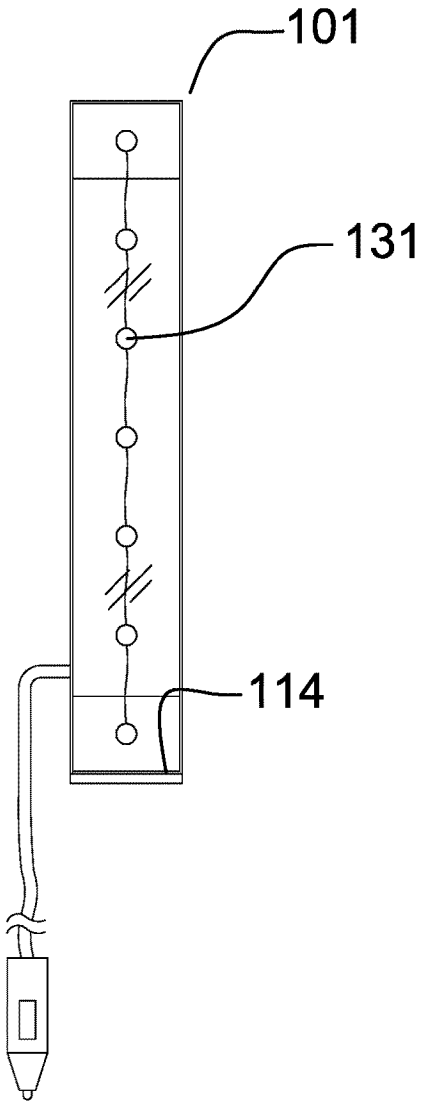
FIG. 4 is a side view of an embodiment of the disclosure.
Figure 6:
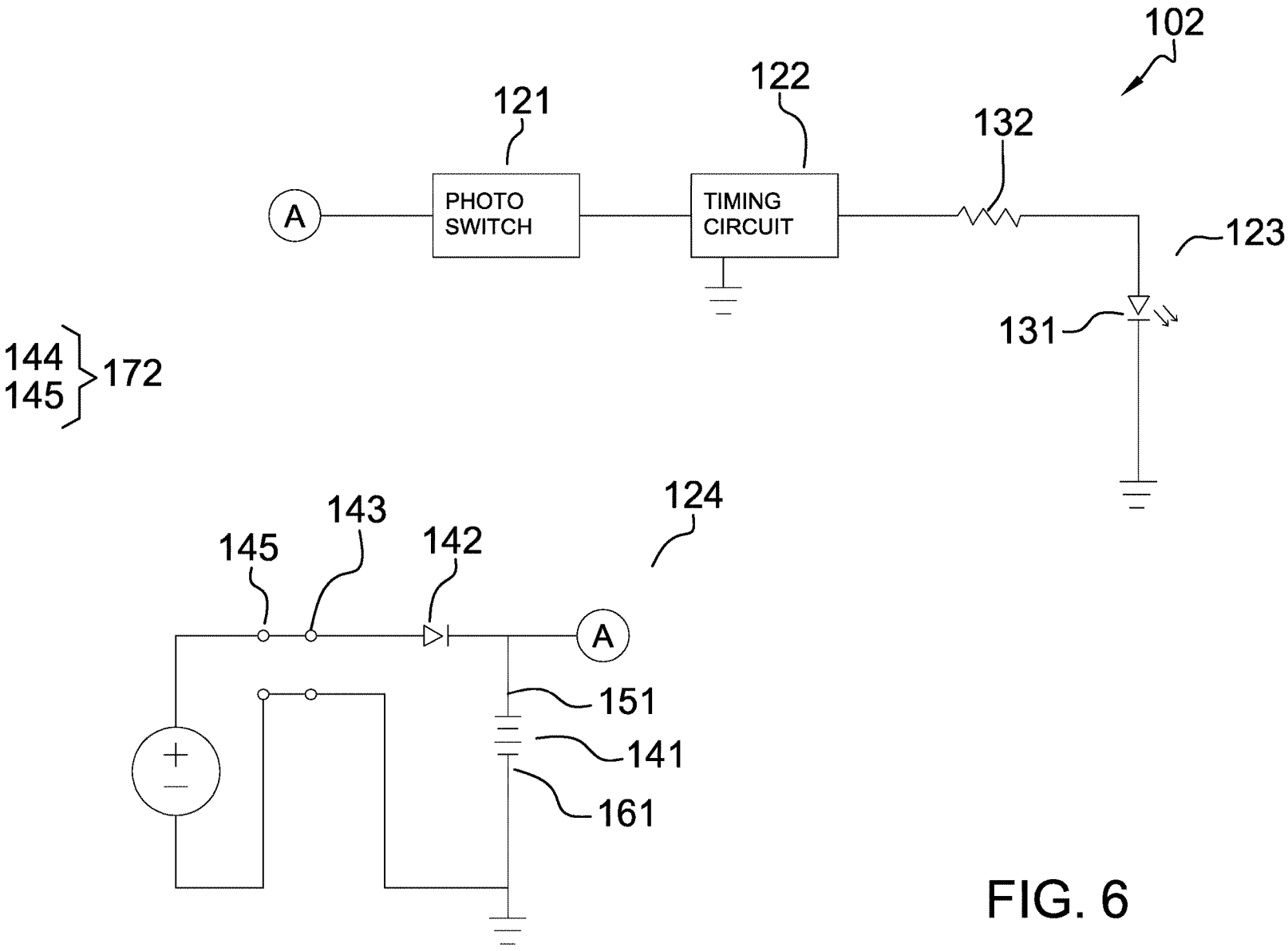
FIG. 6 is a schematic view of an embodiment of the disclosure.

Detailed reference will now be made to one or more potential embodiments of the disclosure, which are illustrated in FIGS. 1 through 6.

The abandoned vehicle messaging sign 100 (hereinafter invention) comprises a housing 101, a control circuit 102, a display surface 103, and a vehicle 171. The control circuit 102 and the display surface 103 mount in the housing 101. The housing 101 mounts on the vehicle 171. The invention 100 displays an image 181 of indicia indicating a sentiment that the vehicle 171 has been abandoned. By abandoned is meant that the vehicle 171 has been left temporarily unattended. The sentiment indicated by the invention 100 is customizable to the specific circumstances regarding the abandonment of the vehicle 171. The vehicle 171 is defined elsewhere in this disclosure. The vehicle 171 electric system 172 is defined elsewhere in this disclosure. The image 181 is defined elsewhere in this disclosure.

The housing 101 is a rigid structure. The housing 101 is a prism-shaped structure. The housing 101 is a transparent structure. The housing 101 contains the control circuit 102 and the display 103. The housing 101 is formed with all apertures and form factors necessary to allow the housing 101 to accommodate the use and operation of the control circuit 102 and the display 103. The housing 101 magnetically attaches to the vehicle 171 when the invention 100 is in use. Methods to form a housing 101 suitable for the purposes described in this disclosure are well-known and documented in the mechanical arts. The housing 101 comprises a pan 111, a lid 112, a hinge 113, and a magnet 114.

The pan 111 is a prism-shaped structure. The pan 111 is a transparent structure. The pan 111 is a rigid structure. The pan 111 has a pan 111 shaped structure. The pan 111 is a hollow structure. The pan 111 contains the display surface 103. The pan 111 presents the display surface 103 such that the image 181 displayed on the vehicle 171 is visible to traffic that passes the vehicle 171. The pan 111 further contains the control circuit 102. The control circuit 102 mounts in the pan 111 such that the illumination of the control circuit 102 visibly illuminates the display surface 103 during periods of darkness. The display surface 103 is accessed through the open face of the pan 111.

The lid 112 is a prism-shaped structure. The lid 112 has a disk shape. The lid 112 is a transparent structure. The lid 112 is sized such that the lid 112 encloses the open face of the pan 111.

The hinge 113 is a fastening structure. The hinge 113 is a rotating structure. The hinge 113 attaches the lid 112 to the pan 111 such that the lid 112 rotates relative to the pan 111. The hinge 113 positions the lid 112 such that the rotation of the lid 112 controls access into the display surface 103 displayed from the pan 111 through the open face of the pan 111.

The magnet 114 is a magnetic structure. The magnet 114 permanently attaches to the interior surface of a face of the pan 111. The magnet 114 removably attaches the housing 101 to the vehicle 171. The magnet 114 secures the housing 101 to a fixed position on the vehicle 171.

The control circuit 102 is an electric circuit. The control circuit 102 illuminates the display surface 103. The control circuit 102 extinguishes the illumination of the display surface 103. The control circuit 102 illuminates and extinguishes the illumination of the display surface 103 in a rhythmic pattern. The control circuit 102 illuminates and extinguishes the illumination of the display surface 103 in a repeating pattern of constant interval. The control circuit 102 is an independently powered electric circuit. By independently powered is meant that the control circuit 102 can operate without an electrical connection to an external power source 144. The control circuit 102 comprises a photoswitch 121, a timing circuit 122, a lamp circuit 123, and a power circuit 124. The photoswitch 121, the timing circuit 122, the lamp circuit 123, and the power circuit 124 are electrically interconnected.

The photoswitch 121 is a light actuated switching circuit. The photoswitch 121 actuates to an open position when the photoswitch 121 is exposed to light. The photoswitch 121 actuates to a closed position when the photoswitch 121 is not exposed to light. The photoswitch 121 controls the flow of electric energy from the power circuit 124 into the timing circuit 122. The photoswitch 121 limits the operation of the timing circuit 122 to periods of darkness. The photoswitch 121 is defined elsewhere in this disclosure.

The timing circuit 122 is an electric circuit. The timing circuit 122 is a timing device. The timing circuit 122 controls the operation of the lamp circuit 123 by controlling the flow of electric energy into the lamp circuit 123. The timing circuit 122 operates in a repeating pattern that: a) applies a voltage to the lamp circuit 123 for a first predetermined amount of time; and subsequently, b) extinguishes the lamp circuit 123 for a second predetermined period of time; before; c) restarting the pattern cycle by reilluminating the lamp circuit 123. The timing circuit 122 is defined elsewhere in this disclosure.

The lamp circuit 123 is an electric circuit. The lamp circuit 123 generates the illumination used to light the image 181 displayed on the display surface 103 during periods of darkness. The timing circuit 122 controls the operation of the lamp circuit 123. The lamp circuit 123 comprises one or more LEDs 131 and a limit resistor 132. The one or more LEDs 131 and the limit resistor 132 are electrically connected.

Each of the one or more LEDs 131 is a two terminal circuit element. Each LED selected from the one or more LEDs 131 generates an illumination when an electric current flows through the selected LED. The timing circuit 122 controls the illumination of the one or more LEDs 131 by controlling the flow of electric current through the one or more LEDs 131. The limit resistor 132 is a two terminal electric circuit element. The limit resistor 132 electrically connects to form a series circuit with the one or more LEDs 131 such that the amount of electric current flowing through the one or more LEDs 131 also flows through the limit resistor 132. The limit resistor 132 protects each of the one or more LEDs 131 by limiting the amount of electric current that can flow through the one or more LEDs 131. The LED and the limit resistor 132 are defined elsewhere in this disclosure.

The power circuit 124 is an electrical circuit. The power circuit 124 powers the operation of the control circuit 102. The power circuit 124 is an electrochemical device. The power circuit 124 converts chemical potential energy into the electrical energy required to power the control circuit 102. The power circuit 124 comprises a battery 141, a diode 142, a charging plug 143, and an external power source 144. The external power source 144 further comprises a charging port 145. The battery 141, the diode 142, the charging plug 143, the external power source 144, and the charging port 145 are electrically interconnected. The battery 141 further comprises a first positive terminal 151 and a first negative terminal 161. The external power source 144 further comprises a second positive terminal 152 and a second negative terminal 162.

The battery 141 is an electrochemical device. The battery 141 converts chemical potential energy into the electrical energy used to power the control circuit 102. The battery 141 is a commercially available rechargeable battery 141. The chemical energy stored within the rechargeable battery 141 is renewed and restored through the use of the charging plug 143. The charging plug 143 is an electrical circuit that reverses the polarity of the rechargeable battery 141 and provides the energy necessary to reverse the chemical processes that the rechargeable battery 141 initially used to generate the electrical energy. This reversal of the chemical process creates a chemical potential energy that will later be used by the rechargeable battery 141 to generate electricity.

The charging plug 143 forms an electrical connection to an external power source 144 using the charging port 145. The charging port 145 forms a detachable electrical connection with the charging plug 143. The charging plug 143 receives electrical energy from the external power source 144 through the charging port 145. The diode 142 is an electrical device that allows current to flow in only one direction. The diode 142 installs between the rechargeable battery 141 and the charging plug 143 such that electricity will not flow from the first positive terminal 151 of the rechargeable battery 141 into the second positive terminal 152 of the external power source 144. In the first potential embodiment of the disclosure, the external power source 144 and the charging port 145 are provisioned through the vehicle 171. The external power source 144 is the vehicle 171 electric system 172. The charging port 145 is the cigarette lighter port of the vehicle 171 electric system 172. The charging plug 143 is a cigarette lighter plug.

The display surface 103 is a disk-shaped structure. The display surface 103 is illuminated by the control circuit 102. The display surface 103 presents an image 181 on a congruent end of the disk structure of the image 181. The display surface 103 presents an image 181 of indicia indicating a sentiment that the vehicle 171 has been abandoned. The image 181 displayed by the display surface 103 is drawn on the display surface 103 such that the sentiment displayed by the invention 100 can be adjusted to match the circumstances of the abandonment of the vehicle 171. The display surface 103 mounts in the housing 101 such that the display surface 103 is visible through the transparent structure of the housing 101. In the first potential embodiment of the disclosure, the display surface 103 is a whiteboard.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power. Batteries are commonly defined with a positive terminal and a negative terminal.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cigarette Lighter Plug: As used in this disclosure, a cigarette lighter plug is a standardized electrical connection that attaches an electrically powered device to the electric power system of a vehicle.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Display: As used in this disclosure, a display is a surface upon which is presented an image, potentially including, but not limited to, graphic images and text, that is interpretable by an individual viewing the projected image in a meaningful manner. A display device refers to an electrical device used to present these images.

External Power Source: As used in this disclosure, an external power source is a source of the energy that is externally provided to enable the operation of the present disclosure. Examples of external power sources include, but are not limited to, electrical power sources and compressed air sources.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Housing: As used in this disclosure, a housing is a rigid structure that encloses and protects one or more devices.

Illumination: As used in this disclosure, illumination refers to electromagnetic radiation contained with an area. Illumination is a synonym for light, particularly in cases where a measure of the amount of visible electromagnetic radiation in a space is called for.

Image: As used in this disclosure, an image is an optical representation or reproduction of an indicia or of the appearance of something or someone.

Indicia: As used in this disclosure, the term indicia refers to a set of markings that identify a sentiment.

Sentiment: As used in this disclosure, a sentiment refers to a symbolic meaning or message that is communicated through the use of an image, potentially including a text based image.

Lamp: As used in this disclosure, a lamp is an electrical circuit that generates (typically visible spectrum) electromagnetic radiation.

LED: As used in this disclosure, an LED is an acronym for a light emitting diode. A light emitting diode is a diode that is also a light source.

Lid: As used in this disclosure, a lid is a removable cover that is placed over an opening of a hollow structure to enclose the hollow structure.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field. A magnet is further defined with a north pole and a south pole. By aligning with an external magnetic field is meant that the north-south pole structure of a first magnet will align with the north south pole of a second magnet. The pole of any first magnet will attract the opposite pole of any second magnet (i.e. a north pole will attract a south pole).

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photoswitch: As used in this disclosure, a photoswitch is a switch that is actuated with light. The operation of a photoswitch is often based on the use of a photoelectric device.

Pivot: As used in this disclosure, a pivot is a rod or shaft around which an object rotates or swings.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force. See bimodal flexible structure.

Sentiment: As used in this disclosure, a sentiment refers to a symbolic meaning or message that is communicated through the use of an image, potentially including a text based image.

Shell: As used in this disclosure, a shell is a structure that forms an outer covering intended to contain an object. Shells are often, but not necessarily, rigid or semi-rigid structures that are intended to protect the object contained within it.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry. The "555" timing circuit is a well-known, documented, and commercially available timing circuit.

Timing Device: As used in this disclosure, a timing device is an automatic mechanism for activating or deactivating a device at a specific time or after a specific period of time. This disclosure assumes that the logic module is provisioned with a timing circuit that can be used as a timing device. A timing device that activates an audible alarm is often referred to as a timer.

Transparent: As used in this disclosure, transparent refers to a material that allows light to pass through the material without significant scattering such that an object can be clearly seen through the material.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor. A motorized vehicle further comprises an electrical system that can be used as a source of electric energy.

Whiteboard: As used in this disclosure, a whiteboard is a surface that is designed to receive non-permanent markings that can be used for communication or recordation purposes. This definition is explicitly intended to include chalkboards. Whiteboards are also commonly referred to as dry erase boards.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A placard comprising a housing, a control circuit, a display surface, and a vehicle;

wherein the control circuit and the display surface mount in the housing;

wherein the housing mounts on the vehicle;

wherein the housing comprises a pan, a lid, a hinge, and a magnet;

wherein the hinge attaches the lid to the pan;

wherein the magnet attaches to the pan;

wherein the control circuit comprises a photoswitch, a timing circuit, a lamp circuit, and a power circuit;

wherein the photoswitch, the timing circuit, the lamp circuit, and the power circuit are electrically interconnected;

wherein the pan is a rigid, transparent structure that is hollow and contains the display surface;

wherein the pan presents the display surface such that the image displayed on the vehicle is visible to traffic that passes the vehicle;

wherein the pan further contains the control circuit;

wherein the control circuit mounts in the pan such that the illumination of the control circuit visibly illuminates the display surface during periods of darkness;

wherein the display surface is accessed through the open face of the pan.

2. The placard according to claim 1 wherein the placard displays an image of indicia indicating a sentiment that the vehicle has been abandoned;

wherein by abandoned is meant that the vehicle has been left temporarily unattended;

wherein the sentiment indicated by the placard is customizable to the specific circumstances regarding the abandonment of the vehicle.

3. The placard according to claim 2 wherein the housing is a rigid structure;

wherein the housing is a transparent structure;

wherein the housing magnetically attaches to the vehicle.

4. The placard according to claim 3 wherein the control circuit is an electric circuit;

wherein the control circuit illuminates the display surface;

wherein the control circuit extinguishes the illumination of the display surface;

wherein the control circuit illuminates and extinguishes the illumination of the display surface in a rhythmic pattern;

wherein the control circuit illuminates and extinguishes the illumination of the display surface in a repeating pattern of constant interval;

wherein the control circuit is an independently powered electric circuit;

wherein by independently powered is meant that the control circuit can operate without an electrical connection to an external power source.

5. The placard according to claim 4 wherein the display surface is a disk-shaped structure;

wherein the display surface is illuminated by the control circuit;

wherein the display surface presents an image on a congruent end of the disk structure of the image;

wherein the display surface presents an image of indicia indicating a sentiment that the vehicle has been abandoned;

wherein the image displayed by the display surface is drawn on the display surface such that the sentiment displayed by the placard can be adjusted to match the circumstances of the abandonment of the vehicle;

wherein the display surface mounts in the housing such that the display surface is visible through the transparent structure of the housing;

wherein the display surface is a whiteboard.

6. The placard according to claim 5 wherein the power circuit is an electrical circuit;

wherein the power circuit powers the operation of the control circuit;

wherein the power circuit is an electrochemical device;

wherein the power circuit converts chemical potential energy into the electrical energy required to power the control circuit.

7. The placard according to claim 6 wherein the power circuit comprises a battery, a diode, a charging plug, and an external power source;

wherein the external power source further comprises a charging port;

wherein the battery, the diode, the charging plug, the external power source, and the charging port are electrically interconnected;

wherein the battery further comprises a first positive terminal and a first negative terminal;

wherein the external power source further comprises a second positive terminal and a second negative terminal.

8. The placard according to claim 7 wherein the lid has a disk shape;

wherein the lid is a transparent structure;

wherein the lid is sized such that the lid encloses the open face of the pan;

wherein the hinge is a rotating structure;

wherein the hinge attaches the lid to the pan such that the lid rotates relative to the pan;

wherein the hinge positions the lid such that the rotation of the lid controls access into the display surface displayed from the pan through the open face of the pan.

9. The placard according to claim 8 wherein the magnet is a magnetic structure;

wherein the magnet permanently attaches to the interior surface of pan;

wherein the magnet removably attaches the housing to the vehicle;

wherein the magnet secures the housing to a fixed position on the vehicle.

10. The placard according to claim 9 wherein the photoswitch is a light actuated switching circuit;

wherein the photoswitch actuates to an open position when the photoswitch is exposed to light;

wherein the photoswitch actuates to a closed position when the photoswitch is not exposed to light;

wherein the photoswitch controls the flow of electric energy from the power circuit into the timing circuit;

wherein the photoswitch limits the operation of the timing circuit to periods of darkness.

11. The placard according to claim 10 wherein the timing circuit is an electric circuit;

wherein the timing circuit is a timing device;

wherein the timing circuit controls the operation of the lamp circuit by controlling the flow of electric energy into the lamp circuit;

wherein the timing circuit operates in a repeating pattern that: a) applies a voltage to the lamp circuit for a first predetermined amount of time; and subsequently, b) extinguishes the lamp circuit for a second predetermined period of time; before; c) restarting the pattern cycle by reilluminating the lamp circuit.

12. The placard according to claim 11 wherein the lamp circuit is an electric circuit;

wherein the lamp circuit generates the illumination used to light the image displayed on the display surface during periods of darkness.

13. The placard according to claim 12 wherein the lamp circuit comprises one or more LEDs and a limit resistor;

wherein the one or more LEDs and the limit resistor are electrically connected.

14. The placard according to claim 13 wherein each of the one or more LEDs is a two terminal circuit element;

wherein each LED selected from the one or more LEDs generates an illumination when an electric current flows through the selected LED;

wherein the timing circuit controls the illumination of the one or more LEDs by controlling the flow of electric current through the one or more LEDs.

15. The placard according to claim 14 wherein the limit resistor is a two terminal electric circuit element;

wherein the limit resistor electrically connects to form a series circuit with the one or more LEDs such that the amount of electric current flowing through the one or more LEDs also flows through the limit resistor;

wherein the limit resistor protects each of the one or more LEDs by limiting the amount of electric current that can flow through the one or more LEDs.

16. The placard according to claim 15 wherein the battery is a rechargeable battery;

wherein the charging plug is an electrical circuit that reverses the polarity of the rechargeable battery;

wherein the charging plug forms an electrical connection to an external power source using the charging port;

wherein the charging port forms a detachable electrical connection with the charging plug;

wherein the charging plug receives electrical energy from the external power source through the charging port;

wherein the external power source and the charging port are provisioned through the vehicle;

wherein the charging plug is a cigarette lighter plug.

17. The placard according to claim 16 wherein the diode is an electrical device that allows current to flow in only one direction;

wherein the diode installs between the rechargeable battery and the charging plug such that electricity will not flow from the first positive terminal of the rechargeable battery into the second positive terminal of the external power source.

* * * * *